United States Patent [19]

Buetemeister

[11] 4,364,344

[45] Dec. 21, 1982

[54] INTERNAL COMBUSTION ENGINE WITH INITIAL IGNITION SUPPRESSION DURING CRANKING

[75] Inventor: Earl H. Buetemeister, Alexandria, Ind.

[73] Assignee: General Motors Corporation, Detroit, Mich.

[21] Appl. No.: 262,314

[22] Filed: May 11, 1981

[51] Int. Cl.[3] ..... F02N 17/00; F02P 5/04

[52] U.S. Cl. ..... 123/179 BG; 123/424; 123/626

[58] Field of Search ..... 123/179 BG, 179 B, 179 R, 123/625, 626, 424

[56] References Cited

U.S. PATENT DOCUMENTS

| | | | |
|---|---|---|---|
| 2,398,259 | 4/1946 | Slayton | 123/179 BG |
| 3,623,464 | 11/1971 | Patis | 123/625 |
| 3,838,672 | 10/1974 | Richards et al. . | |
| 3,985,109 | 10/1976 | Kondo et al. | 123/625 |
| 4,133,325 | 1/1979 | West | 123/424 |
| 4,157,699 | 6/1979 | Mori | 123/424 |

FOREIGN PATENT DOCUMENTS

| | | | |
|---|---|---|---|
| 2905901 | 8/1980 | Fed. Rep. of Germany | 123/424 |
| 2042638 | 9/1980 | United Kingdom | 123/424 |

*Primary Examiner*—P. S. Lall

*Attorney, Agent, or Firm*—Robert M. Sigler

[57] ABSTRACT

A spark ignited internal combustion engine includes a counter which counts a predetermined number of the initial ignition signals during engine start and suppresses those ignition signals to prevent reverse torque due to excessive cylinder pressure before top dead center at the extra-low engine speed of initial start and thus assist engine start, especially in a warm engine. The counter is reset by detection of the closure of the ignition switch through the electric power supply line so that no separate wire from the start switch or motor is required.

3 Claims, 2 Drawing Figures

INTERNAL COMBUSTION ENGINE WITH INITIAL IGNITION SUPPRESSION DURING CRANKING

BACKGROUND OF THE INVENTION

This invention relates to spark ignited internal combustion engines of the type which are started by an accessory starting or cranking motor. Such engines are generally provided with spark timing apparatus to generate sparks in the cylinders of the engine at times somewhat in advance of the times when peak cylinder pressure is desired during the power strokes of the pistons in said cylinders. Since combustion within the cylinder takes place at a rate which changes little with varying engine speed, it has been considered desirable to provide a variable spark timing advance with respect to top dead center, which advance increases with engine speed and has been generally known as centrifugal advance. The centrifugal advance has traditionally been added to a certain base engine spark timing which is specified for a particular engine and mechanically fixed by positioning of the distributor during the engine tuning process. This base engine spark timing represents the least possible advance for the typical mechanical engine spark timing system and is calibrated for typical low engine speed such as idle. However, even during idle, the typical internal combustion engine is rotating at 400 revolutions per minute or greater; and the basic timing is therefore often substantially in advance of top dead center.

When such an engine is initially started, it is rotated by an external accessory cranking motor, beginning from a resting condition. Spark events are generated in the cylinders in the normal order from the very beginning of cranking at times determined by the basic timing of the engine. However, the first several such spark events occur with the engine cranking at a speed which is far lower than even the normal idle speed. At such a low speed, a spark event generated at a crank angle of 6° before top dead center, for example, may, under the right conditions in certain engines, produce a cylinder pressure which peaks or at least becomes substantially great before the top dead center position is reached. If this occurs, the pressure of the ignited gases produces a reverse torque which hinders the starting motor in its attempt to accelerate the engine. In fact, since it is most likely to occur on the first engine spark event, it has been known in some cases to prevent the starting motor from starting the engine. This condition has been known as hot stall, since the engine condition most conducive to the problem is that of warm engine temperature. When the engine is warm, the combustion flame front travels faster and the cylinder walls absorb less heat, thus producing an earlier and more powerful peak pressure. In addition, in a warm engine the ignition of the fuel in a cylinder on the very first spark event is much more certain: in a cold engine, on the other hand, the first few ignition events often fail to ignite the fuel mixture and engine speed thus is allowed to increase to a significant value before the first combustion event occurs.

In the past, the easiest solution to such a hot start problem, in the few instances in which it occurred, was to provide a larger, more powerful starting motor. However, as fuel efficiency has assumed greater importance in engine design and every attempt has been made to reduce the weight of motor vehicles in every way possible, it has become desirable to decrease the size of the starting motor and find a different method of solving the hot start problem. One such method has been found in the development of more sophisticated electronically controlled engine spark timing systems in which the actual spark timing is computed relative to an earlier occurring crankshaft synchronized marking pulse which could be set arbitrarily at a point after top dead center. During initial start of the engine, the normal spark timing process could be suppressed in favor of one which generated spark events at the times of the marker pulses themselves.

However, there are still engines using traditional mechanical spark timing control systems which will continue to use such systems for cost or other reasons. It is therefore desirable to provide an improvement in the traditional engine spark timing system which will overcome the problem of hot start in a manner which provides the minimum of costly changes to that system. One approach to this problem is to suppress or prevent ignition at the initiation of engine start or cranking and prevent the ignition events until the engine has built-up sufficient rotational speed to overcome the hot start problem.

To the knowledge of the inventor herein, there have been several publications of apparatus to prevent ignition events during initial starting of a spark ignited internal combustion engine for reasons other than the hot start problem. For example, the U.S. Pat. No. 3,623,464 discloses ignition apparatus for an outboard marine engine in which no spark events are allowed until the engine rotational speed exceeds a predetermined reference. This is done for safety reasons to prevent accidental starting of the engine by someone adjusting or working thereon. This is accomplished by sensing the output of the engine driven alternator as an indication of engine speed. The U.S. Pat. No. 2,398,259 provides a cold start engine starting aid which delays the application of ignition voltage during initial engine cranking for a time determined by a thermostatic timer. In this case, the warmer the engine is, the shorter the delay will become; and, in fact, if the ambient temperature is sufficiently greater than 10° F., there will be no delay at all. U.S. Pat. No. 2,478,739 shows a cold start enhancing ignition system which provides a special high current to the coil during engine start when the battery voltage is lowered by the drain of the starting motor but delays the application of the higher current for a short time by means of a mechanical timer comprising a set of gears so that the higher current will not be applied with possible damage to the coil before the battery voltage is actually lowered.

The preceding references show systems which, although they provide for the delay in the application of spark ignition signals during initial cranking of a spark ignited internal combustion engine, either fail to do so at the most desirable time for the hot start problem or involve cumbersome or otherwise inappropriate apparatus. It is therefore an object of this invention to provide spark timing apparatus for a spark ignited internal combustion engine which aids the starting of a warm engine by preventing the initial ignition events during engine start.

In furtherance of this object, this invention uses a counter to count the initial ignition signals as they occur during engine start and prevents ignition events in response to said signals for a predetermined number of said ignition signals. The use of a counter rather than, for example, a timer is advantageous in that the number of suppressed ignition events is controlled directly and precisely regardless of the performance of the cranking motor; the faster the cranking motor accelerates the engine, the sooner normal ignition is begun. In addition, a counter is not as dependent on temperature and other environmental factors as is an RC circuit or other practical timer in the control of the duration of the suppressed ignition.

Further details and advantages of this invention will be apparent from the accompanying drawings and following description of a preferred embodiment.

DESCRIPTION OF A PREFERRED EMBODIMENT

Figure 1:
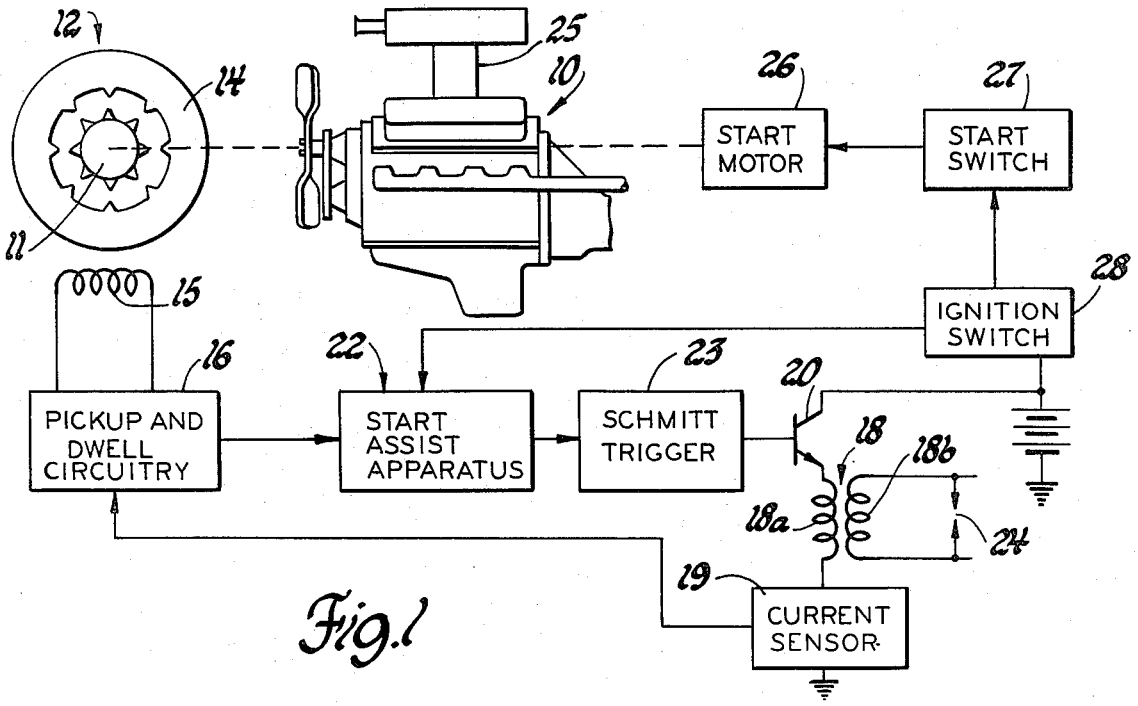
FIG. 1 is a schematic and block diagram of a spark ignited internal combustion engine according to this invention.

Referring to FIG. 1, an internal combustion engine 10 has a rotating crankshaft which drives the rotor 11 of an alternating current signal generator 12. Generator 12 is a standard spark timing signal generator of the variable reluctance type disclosed and described in U.S. Pat. No. 3,254,247 to Falge, which issued May 31, 1966. Generator 12 also includes a stator 14 and pickup coil 15 and provides a plurality of equally spaced projections around rotor 11 and stator 14 related to the number of cylinders in engine 10. Relative rotation between the rotor 11 and stator 14 at a speed proportional to engine speed produces a pulsating variation in reluctance which induces an alternating voltage signal in coil 15.

The alternating voltage signal in coil 15 is applied to pickup and dwell circuitry 16, which generates ignition timing pulses. These ignition timing pulses could be applied to a Schmitt trigger 23 to control a switching transistor 20 connected to switch current on and off in the primary 18*a* of a spark coil 18. The flow of current in primary 18*a* causes electromagnetic energy to build up in spark coil 18; and this energy is released, when transistor 20 cuts off current in primary 18*a*, in the form of a high voltage spark pulse in coil secondary 18*b*, which is applied to spark plug 24 through a standard distributor, not shown. A current sensor 19 provides feedback to pickup and dwell circuitry 16 to control the dwell time of current conduction in primary 18*a*. The system so far described is shown in the patent to Richards et al U.S. Pat. No. 3,838,672, issued Oct. 1, 1974. The spark ignites a fuel charge supplied to the cylinder by standard fuel supply apparatus 25.

A start or cranking motor 26 is provided to start engine 10 in the usual manner by turning the crankshaft through a toothed flywheel. Start motor 26 is actuated by a start switch 27, which itself receives power through the vehicle ignition switch 28. A start assist apparatus 22, which also receives electrical power through ignition switch 28, is inserted between pickup and dwell circuitry 16 and Schmitt trigger 23. During most conditions of engine operation, start assist apparatus 22 receives the ignition timing signals from pickup and dwell circuitry 16 and passes them unchanged to Schmitt trigger 23 so that ignition events will be generated in spark plugs 24. However, initial actuation of ignition switch 28 resets a counter within start assist apparatus 22 to prevent a predetermined number of ignition timing signals from reaching Schmitt trigger 23 when start switch 27 first actuates start motor 26. Of course, the counter could be reset by a signal from start switch 27, but the ability of start assist apparatus 22 to detect initial ignition switch closure means that a separate wire does not have to be connected from the start switch 27 to start assist apparatus 22, for a significant cost saving advantage.

Figure 2:
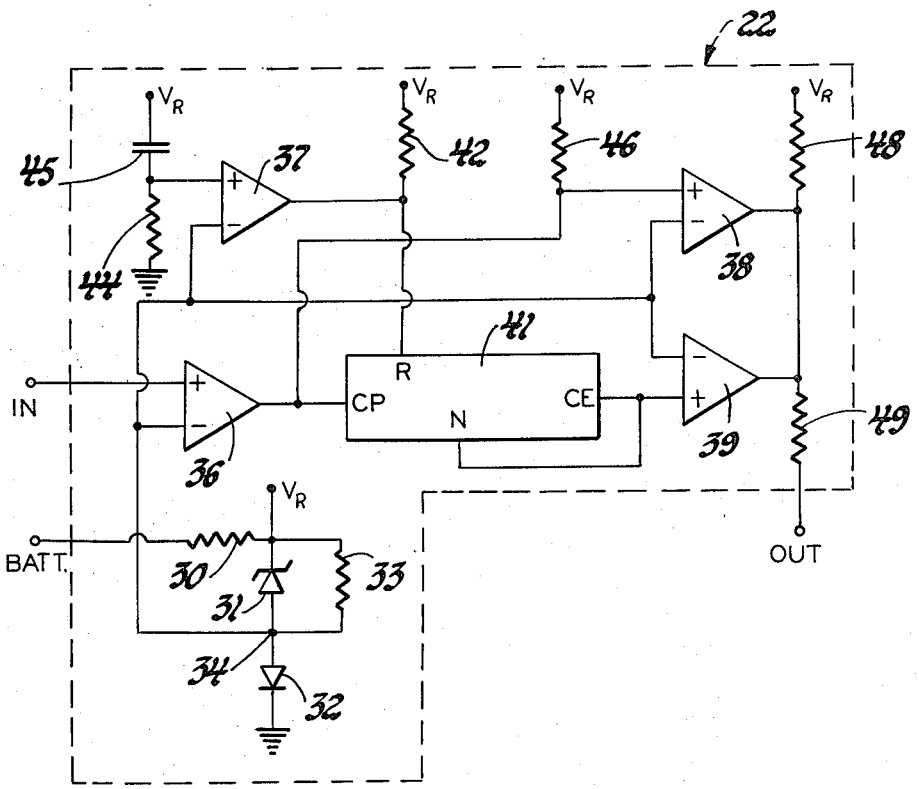
FIG. 2 is a circuit diagram of a start assist apparatus intended for use in the system of FIG. 1.

A preferred circuit embodiment of start assist apparatus 22 is shown in FIG. 2. Referring to FIG. 2, battery voltage is supplied to input BATT, from which it is applied through a resistor 30 to the cathode of the zener diode 31. The anode of zener diode 31 is connected to the anode of a diode 32, whose cathode is grounded; and a resistor 33 is connected across zener diode 31 in parallel. A regulated high voltage of approximately 7 volts, determined by an appropriate voltage value for zener 31, is available from the pin labeled $V_R$; while a regulated voltage of one diode drop or about 0.7 volts is available at junction 34 of diodes 31 and 32. Resistor 33 provides current flow around zener diode 31 to preserve the voltage at junction 34 if the input battery voltage should fall low enough to stop conduction through zener diode 31.

The voltage from junction 34 is provided to the inverting inputs of four comparators 36, 37, 38 and 39, which are part of an LM-239 chip. Thus, a voltage of approximately 0.7 volts is provided to the inverting input of each of the comparators to provide a voltage switching reference level therefor. This voltage is sufficiently high to hold the output of the comparator low if the non-inverting input is grounded in spite of the possible presence of some noise in the circuit.

The pulse output wave of pickup and dwell circuitry 16 is provided to the terminal labeled IN, from which it is applied to the non-inverting input of comparator 36. The output of comparator 36 is connected to the non-inverting input of comparator 38 and also to the count input CP of a counter 41. Counter 41 further has a reset input connected to the output of comparator 37 and, through a resistor 42, to the regulated voltage $V_R$. The counter further has a count enable input CE, connected to the non-inverting input of comparator 39, and a plurality of outputs, each associated with a different count and only one of which, output N, is shown. Output N could be, for example, the output which assumes a high level when the counter reaches 4. This output is connected to the non-inverting input of comparator 39 and thus also to the count enable input CE. When counter 41 is reset by a high input to reset input R, each successive rising pulse applied to count input CP moves the high output level to the next output, until output N is reached. The high voltage from output N is applied to input CE to stop the counter from counting and thus latch the counter output high until the next reset pulse is received.

The non-inverting input of comparator 37 is connected through a resistor 44 to ground and through a capacitor 45 to the regulated voltage $V_R$. The non-inverting input of comparator 38 is connected through a resistor 46 to the regulated voltage $V_R$. The outputs of comparators 38 and 39 are connected together and through a resistor 48 to the regulated voltage $V_R$. They are further connected through a resistor 49 to the output terminal OUT and from there through the Schmitt trigger circuitry to ground. Since comparators 36–39 have open collector transistor outputs, comparators 38-39 thus have their outputs connected in a hard wired OR gate.

When the output N of counter 41 is low, which will occur while counter 41 is still counting up to N, comparator 39 has its output transistor turned on to produce a low output, regardless of the output condition of comparator 38. This corresponds to an OR gate with one input on which produces an output on signal regardless of the condition of the other input. Thus, in this condition, any signal applied to the input IN and supplied from there through comparator 36 to comparator 38 will have no effect on the output at terminal OUT; and, therefore, any ignition timing pulses thereon will generate no ignition events, although they will be supplied to input CP of counter 41 to be counted.

When the predetermined number of ignition timing pulses have been counted by counter 41 and output N thus assumes a high level, the output transistor of comparator 39 is turned off to effectively remove comparator 39 from the circuit and allow comparator 38 to control the output terminal OUT in response to the signal at the input terminal IN provided through comparator 36. The high voltage on input CE of counter 41 prevents further counting until the reset pulse is received; and ignition events are generated at the times determined by the ignition time signals from the pickup and dwell circuitry 16.

The reset signal is received from comparator 37 when battery voltage is first supplied to input BATT of this apparatus. The capacitor 45 and resistor 44 form a differentiator at the non-inverting input of comparator 37 to provide an output pulse therefrom upon a sudden initial surge of charging current through capacitor 45, such as will occur only when the vehicle ignition is first energized by the closure of ignition switch 28. Thus, a separate wire from the start switch is avoided for a significant cost saving.

Therefore, the basic spark timing of the engine can be set to some crankshaft angle in advance of top dead center without fear of hot start problems. When the vehicle operator closes the ignition switch and then the start switch, the cranking motor cranks the engine crankshaft for a predetermined number of potential spark events with no spark to allow rotational speed and inertia to increase. After the predetermined number is reached, normal spark events are generated and the engine begins to accelerates under its own power.

Sample components for the circuit of FIG. 2 are as follows:

Comparators: 36, 37, 38, 39 — LM239
Diodes:
31 — IN4735, 6.2v
32 — IN914
Counter: 41 — MC14022B
Resistors:
30 — 390 ohms
33 — 8.2K
44 — 51K
42, 46, 48 — 5.1K
49 — 100 ohms
Capacitor: 45 — 0.047 microfarad The above described embodiment is a preferred embodiment; but those skilled in the art will recognize equivalents. Therefore this invention should be limited only by the claims which follow.

The embodiments of the invention in which an exculsive property or privilege is claimed are defined as follows:

1. In a multi-cylinder internal combustion engine having a rotating crankshaft, a piston in each of the cylinders coupled to the crankshaft in rotational driving relationship, means effective to deliver fuel charges to the respective cylinders at predetermined times, means effective to normally ignite the fuel charges in the respective cylinders in response to ignition signals at predetermined times in advance of top dead center in the respective cylinders and means effective to start the engine by independent rotation of the crankshaft, the improvement comprising:

counting means effective during initial actuation of the engine start means to count a predetermined number of said ignition signals;

means effective, while the counting means is counting, to prevent ignition in the respective cylinders, whereby crankshaft rotational speed is allowed to increase without reverse torque due to ignition cylinder pressure buildup before top dead center; and means responsive to the counting means reaching the predetermined count to restore ignition in the respective cylinders, whereby the pistons are enabled to drive the crankshaft after crankshaft rotational speed is sufficient to maintain engine operation with ignition events before top dead center.

2. In a multi-cylinder internal combustion engine having a rotating crankshaft, a piston in each of the cylinders coupled to the crankshaft in rotational driving relationship, means effective to deliver fuel charges to the respective cylinders at predetermined times, means effective to normally ignite the fuel charges in the respective cylinders in response to ignition signals at predetermined times in advance of top dead center in the respective cylinders, electric power means including an ignition switch and means effective to start the engine by independent rotation of the crankshaft, the improvement comprising:

counting means effective when reset to count an initial predetermined number of said ignition signals during initial activation of the engine start means after said reset;

means responsive to initial closure of the ignition switch to reset the counting means;

means effective, while the counting means is counting, to prevent ignition in the respective cylinders, whereby crankshaft rotational speed is allowed to increase without reverse torque due to ignition cylinder pressure buildup before top dead center; and means responsive to the counting means reaching the predetermined count to restore ignition in the respective cylinders, whereby the pistons are enabled to drive the crankshaft after crankshaft rotational speed is sufficient to maintain engine operation with ignition events before top dead center.

3. In a multi-cylinder internal combustion engine having a rotating crankshaft, a piston in each of the cylinders coupled to the crankshaft in rotational driving relationship, means effective to deliver fuel charges to the respective cylinders at predetermined times, means effective to normally ignite the fuel charges in the respective cylinders in response to ignition signals at predetermined times in advance of top dead center in the respective cylinders, electric power means including an ignition switch and means effective to start the engine by independent rotation of the crankshaft, the improvement comprising:

an RC differentiator circuit effective to generate a reset signal upon closure of the ignition switch;

a counter responsive to said reset signal to generate a first output and count ignition signals upon initial activation of the engine start means after said closure of the ignition switch, said counter being effective to generate a second output upon counting a predetermined number of said ignition signals;

logic means effective to receive the ignition signals and counter output and suppress the ignition signals when the first counter output is present and pass the ignition signals when the second counter output signal is present; and means effective to provide the ignition signals, when not suppressed, from the logic means to the ignition means to ignite the fuel charges.

* * * * *